US007146653B2

(12) United States Patent
Chou

(10) Patent No.: US 7,146,653 B2
(45) Date of Patent: Dec. 12, 2006

(54) SIDE BUCKLE STRUCTURE OF SWIMMING GOGGLES

(75) Inventor: Shu-Fang Chou, Yonghe (TW)

(73) Assignee: First Rank Co., Ltd., Hsin Chaung (TW)

( * ) Notice: Subject to any disclaimer, the term of this patent is extended or adjusted under 35 U.S.C. 154(b) by 48 days.

(21) Appl. No.: 11/094,170

(22) Filed: Mar. 31, 2005

(65) Prior Publication Data

US 2006/0218757 A1 Oct. 5, 2006

(51) Int. Cl.
*A61F 9/02* (2006.01)

(52) U.S. Cl. ..... 2/426; 2/428; 2/448; 24/170; 24/636

(58) Field of Classification Search ..... 24/170, 24/265 BC, 68 SK, 71 SK, 629, 636, 637; 2/426, 428, 448; 351/43
See application file for complete search history.

(56) References Cited

U.S. PATENT DOCUMENTS

| | | | | |
|---|---|---|---|---|
| 6,349,420 | B1 * | 2/2002 | Chiang | 2/428 |
| 6,961,965 | B1 * | 11/2005 | Chiang | 2/452 |
| 7,020,905 | B1 * | 4/2006 | Chiang | 2/448 |
| 2006/0010585 | A1 * | 1/2006 | Chiang | 2/426 |
| 2006/0015990 | A1 * | 1/2006 | Chiang | 2/426 |
| 2006/0059607 | A1 * | 3/2006 | Chiang | 2/426 |

* cited by examiner

*Primary Examiner*—Robert J. Sandy

(57) ABSTRACT

A side buckle structure of swimming goggles includes a side buckle casing, a press-button seat, a press button, and a head strap. The side buckle casing has a press-button hole, and the press-button seat has a latching hook, a strap hole, placing holes, and elastic devices. Rotating axes, a pressing piece, and a supporting piece are contained in the press button, which is installed on the press-button seat and then inserted into the side buckle casing. According to the aforementioned structure, the side buckle structure is easy to assemble, difficult to dismantle, and very convenient to adjust in usage.

4 Claims, 4 Drawing Sheets

SIDE BUCKLE STRUCTURE OF SWIMMING GOGGLES

BACKGROUND OF THE INVENTION a) Field of the Invention

The present invention relates to a side buckle structure of a swimming goggle, and more particularly to a side buckle structure, installed at two sides of an ordinary swimming goggle, which has advantages of easiness of assembling and difficulty in dismantling, and is also very convenient to adjust in usage.

b) Description of the Prior Art

There is a plurality of kinds of conventional swimming goggles, such as a kind of single lens goggles or a kind of dual lens goggles. Of which the dual lens swimming goggle is a more popular one in the market, due to a wide view angle of its lenses and comfort after wearing on. As shown in FIG. 1, a lens a and a cushion pad b of a swimming goggle are integrally fixed in a tightly pressing fashion by a lens frame c which comprises a first frame c1, a second frame c2, a connection part located at a center of the goggle for connecting an upper and lower edges of the first frame c1 with the second frame c2, and slots c3 for clipping the lens a with the cushion pad b. In addition, pressing devices c11 and c21 are located at a side of the first frame c1 and of the second frame c2. Seats c11 and c212 with holes c111 and c211, which are located at the first frame c1 and the second frame c2, respectively, and bottom caps d1 and face caps d2 which tightly latch the holes c111 and c211, provide passage for a head strap e of the swimming goggle and can be assembled into an integral body, are included in the pressing devices c11 and c21. Therefore, the lens a and the cushion pad b can be firmly assembled into the slot c3 of the lens frame c by latching and tightly pressing the connection part with the bottom caps d1 and the face caps d2. According to the aforementioned structure, a latching groove c12 of the first frame c1 and a latching bar c22 located at the second frame c2 are used to latch a central part of the first frame c1 and of the second frame c2 into an integral body, whereas a slant bar d11, which is located on the bottom cap d1, is used to latch the holes c111 and c211 of the first frame c1 and of the second frame c2 into an integral body. Moreover, a latching hole d21 is located on the face cap d2 at a position relative to the slant bar d11 and can be latched therewith, and a passage area d12 of the head strap e, which is divided into two parts by a spacing bar d121, is located at a position adjacent to the slant bar d11, to enable passing and surrounding the head strap e. As the bottom cap d1 and the face cap d2 are installed on the holes c111 and c211, a rotation in a small angle can be taken, thereby having the advantages of convenience in using and adjusting. However, the connection method for the slant bar d11 and the holes c111 and c211 is not firm enough, causing a dismantlement of the entire swimming goggle and inducing unnecessary problems in usage to a user, provided that looseness occurs. Therefore, a side buckle structure for a swimming goggle which has the advantages of easiness of assembling and difficulty in dismantling and is more convenient and faster to adjust a tightness of the head strap, is specifically designed by the inventor.

SUMMARY OF THE INVENTION

The primary object of the present invention is to provide a side buckle structure for a swimming goggle, which has the advantages of easiness of assembling and difficulty in dismantling, and is more convenient to adjust in usage.

Accordingly, the present invention includes primarily a side buckle casing, a press-button seat, a press button, and a head strap, wherein two ends of the side buckle casing have openings and a press-button hole is located thereon. An opening at one end is used for installing the press-button seat and the press button, whereas an opening at the other end forms a passage area for the head strap with a strap hole of the press-button seat. A latching hook is located at the other end of the press-button having the strap hole, and placing holes are located at proper positions on two side walls of the press-button seat, respectively, along with elastic devices located adjacent to the placing holes. Moreover, two rotating axes are extended outward from two edges of the press button, and a pressing piece and a supporting piece are located at two sides of the press button. When the press button is installed on the press-button seat, the rotating axes are first installed in the placing holes and the supporting piece is put against the elastic device. After being installed on the press-button seat, the press button is then inserted into an opening at one end of the side buckle casing, enabling the press button to be passed out from the press-button hole. Finally, the head strap is surrounded and passed into the strap hole, which completes the assembling.

Upon assembling according to the aforementioned structure, the press button is put in an opening at one end of the side buckle casing, after putting the press button into the press-button seat according to a correct direction and latching the latching hook at one end of the press-button seat into a hole at a side of the lens frame, enabling the press button to be passed out from the press-button hole, and finally followed by surrounding and passing the head strap into the strap hole. Therefore, It is very convenient to assemble and difficult to dismantle after assembling. In usage, by pressing a part of the press button protruding out of the side buckle casing, an elastic force is generated by the elastic device at a bottom of the press-button seat, thereby lifting up the pressing piece at the other end of the press button, enabling the head strap to be freely gliding in the passage area, and thus having the advantage of convenience in adjusting.

To enable a further understanding of the said objectives and the technological methods of the invention herein, the brief description of the drawings below is followed by the detailed description of the preferred embodiments.

DETAILED DESCRIPTION OF THE PREFERRED EMBODIMENTS

Figure 1:
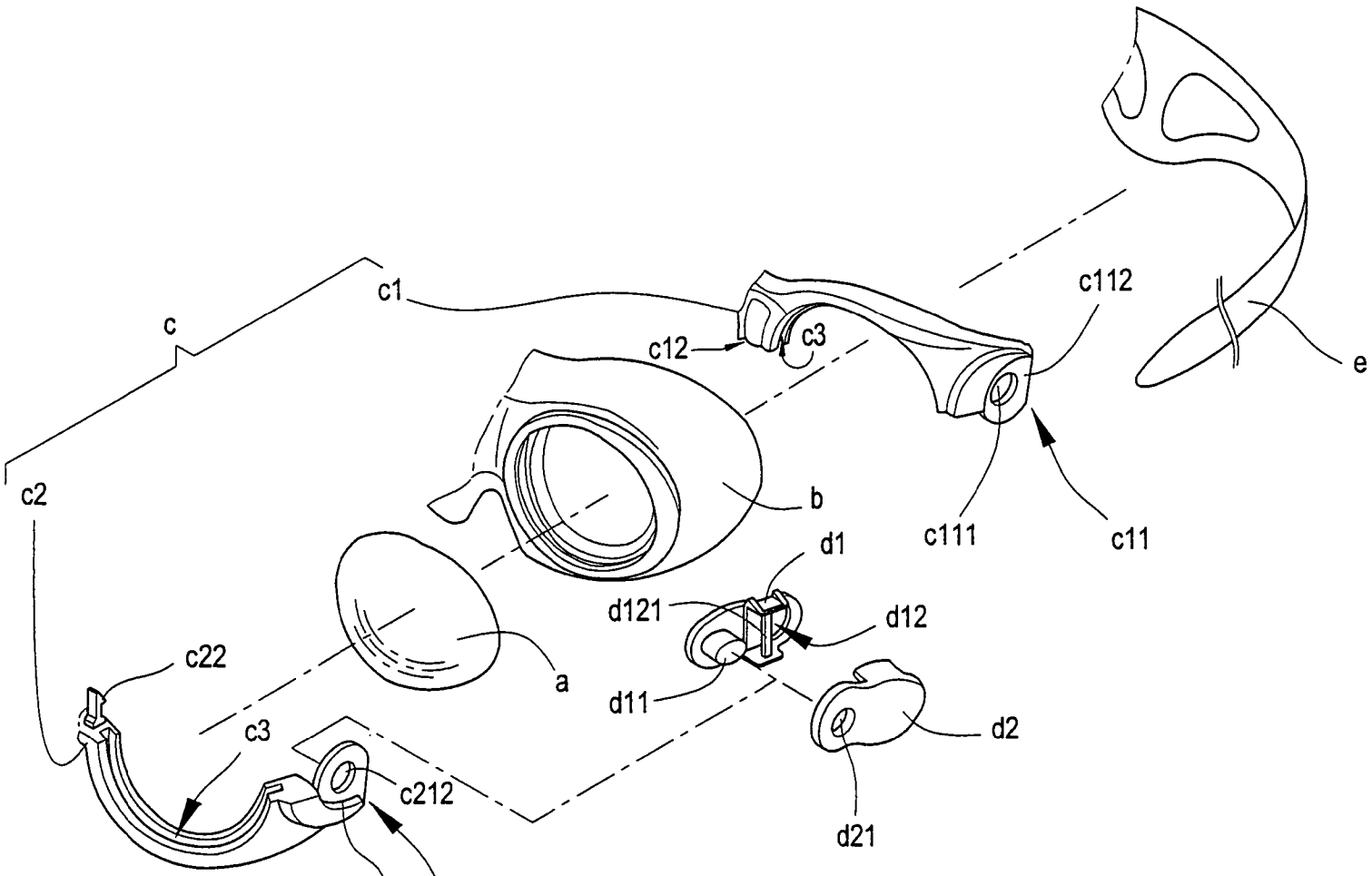
FIG. 1 ( PRIOR ART )
FIG. 1 shows a perspective view of a conventional structure.
Figure 2:
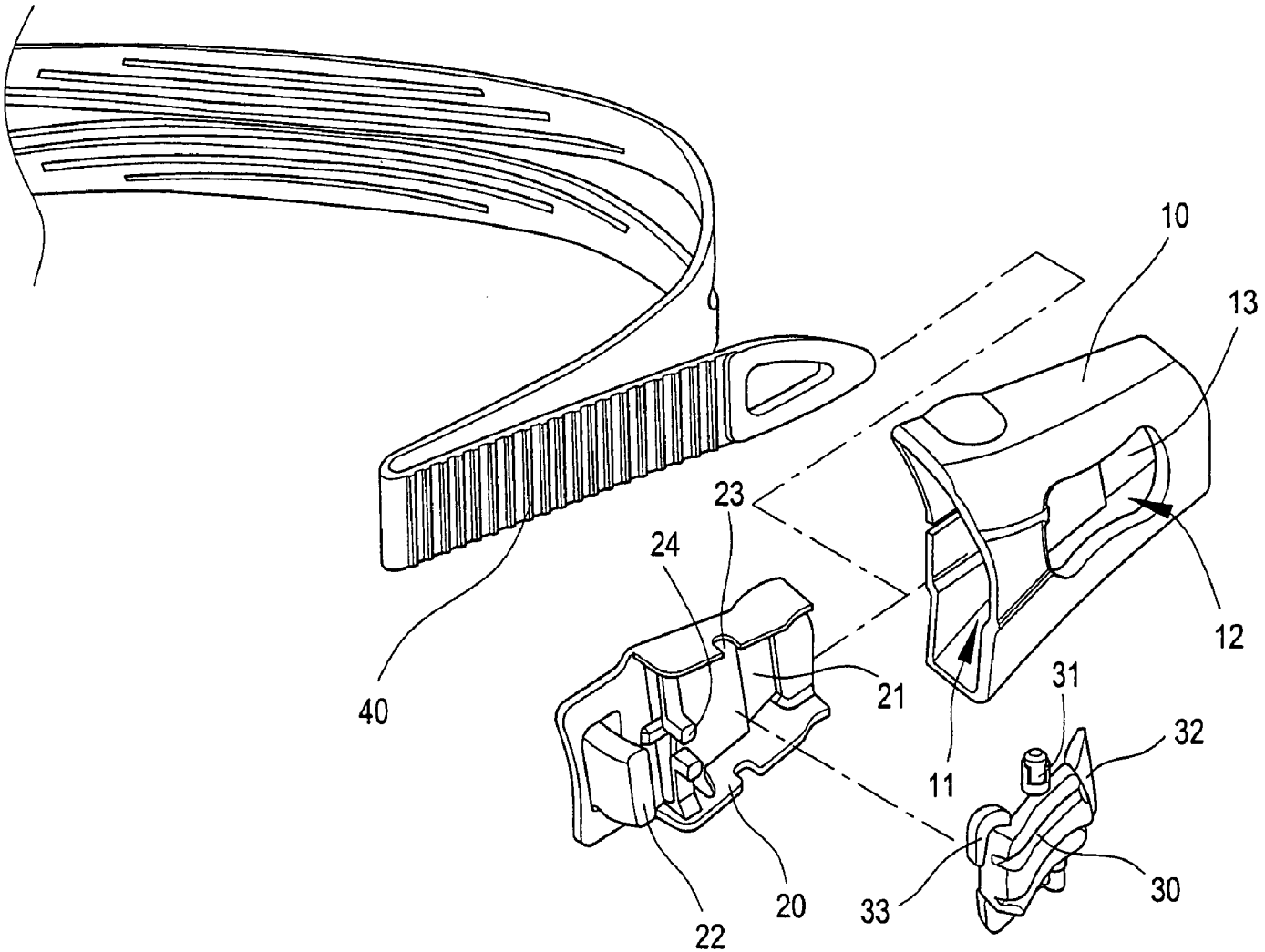
FIG. 2 shows a perspective view of dismantling of the present invention.
Figure 3:
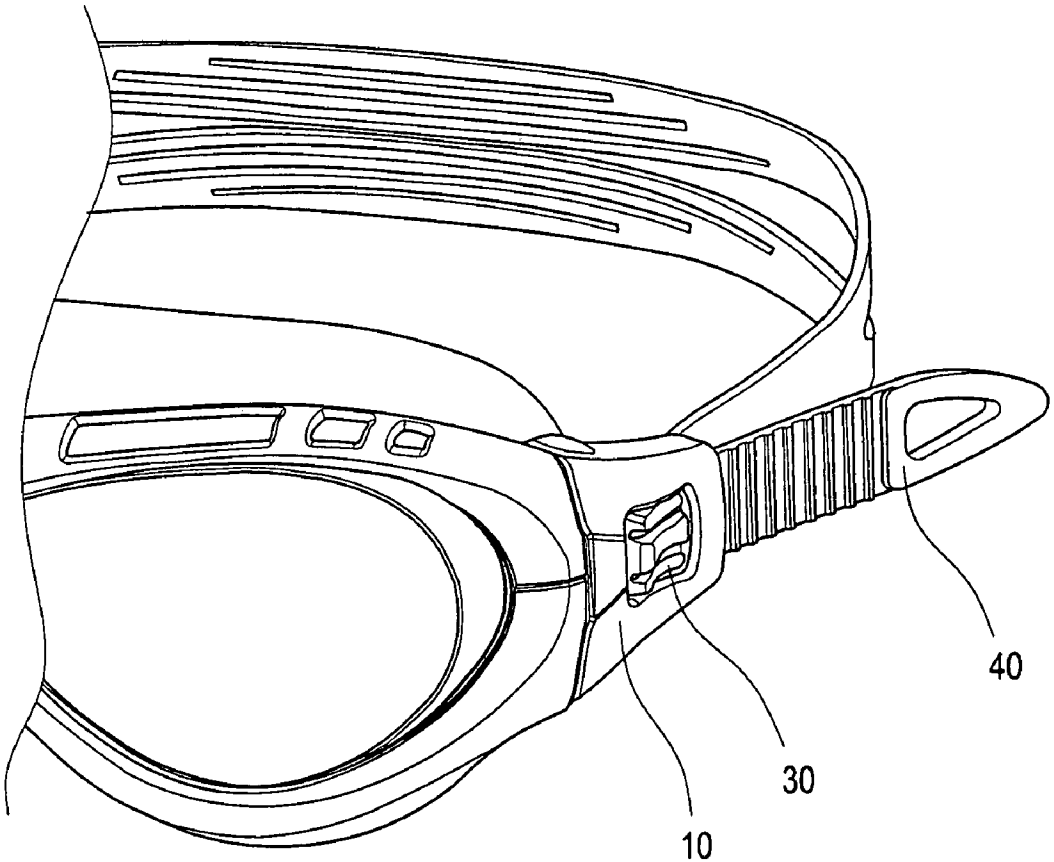
FIG. 3 shows a perspective view of assembling of the present invention.
Figure 4:
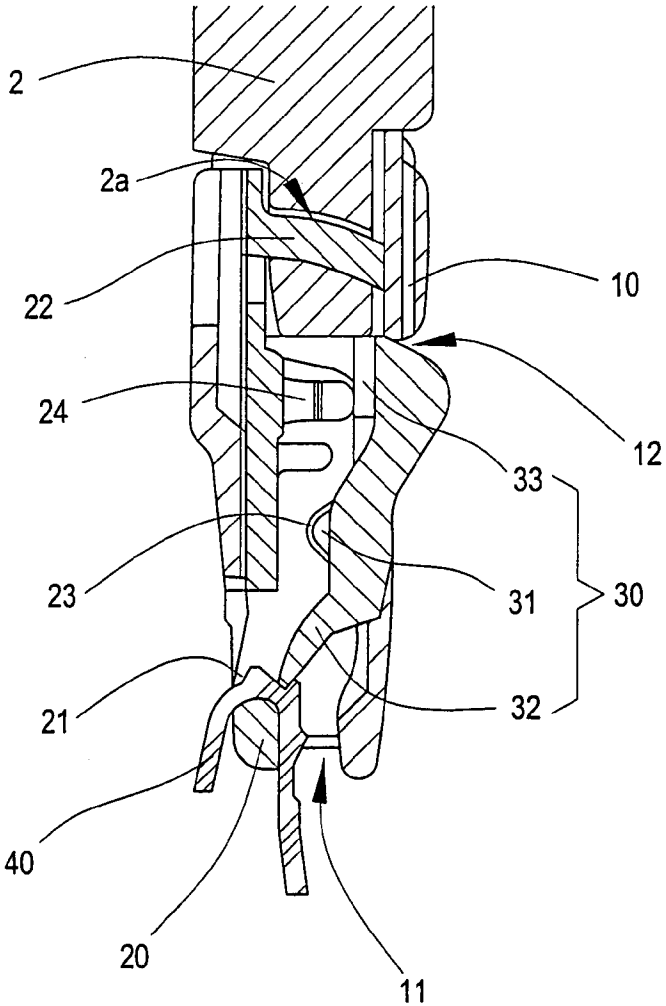
FIG. 4 shows a cross sectional view of assembling of the present invention.

Referring to FIG. 2, FIG. 3, and FIG. 4, the present invention comprises primarily a side buckle casing 10, a press-button seat 20, a press button 30 and a head strap 40, wherein the side buckle casing 10 has openings 11 at two ends, and a press-button hole 12 is located thereon. An opening 11 at one end of the side buckle casing is used for installing the press-button seat 20 and the press button 30, whereas an opening 11 at the other end forms a passage area 13 for passing the head strap 40 with a strap hole 21 of the press-button seat 20. Moreover, the strap hole 21 is located at one end of the press-button seat 20, and a latching hook 22 is located at the other end having the strap hole 21. Placing holes 23 are located at proper positions on two side walls of the press-button seat 20, and elastic devices 24 are adjacent to the placing holes 23. Two rotating axes are extended outward from two edges of the press button 30, with a pressing piece 32 and a supporting piece 33 located at two ends of the press button 30, respectively.

Upon assembling, after putting the press button 30 in the press-button seat in a correct direction, the two rotating axes 31 at two ends of the press button 30 are installed into the placing holes 23, and the supporting piece 33 is put against the elastic device 24. Next, the press button 30 is installed on the press-button seat 20 and then inserted into an opening 11 at one end of the side buckle casing 10, after latching the latching hook 22 at one end of the press-button seat 20 into holes 2*a* at two sides of a lens frame 2, enabling the press button 30 to be passed out from the press-button hole 12. Finally, the head strap 40 is surrounded and passed into the strap hole 21.

Accordingly, the present invention comprises a side buckle casing, a press-button seat, a press button, and a head strap, which is easy to assemble, difficult to dismantle, and very convenient to adjust in usage.

It is of course to be understood that the embodiments described herein is merely illustrative of the principles of the invention and that a wide variety of modifications thereto may be effected by persons skilled in the art without departing from the spirit and scope of the invention as set forth in the following claims.

What is claimed is:

1. A side buckle structure of swimming goggles which is installed at two sides of a lens frame, respectively, into which a head strap is passed, and with which a tightness upon wearing a swimming goggle can be fast adjusted by pressing a press button; the side buckle structure including a side buckle casing, a press-button seat, a press button, and a head strap; a press-button hole located on a top of the side buckle casing, and a latching hook and a strap hole located at two ends of the press-button seat, respectively; placing holes and elastic devices located at proper positions on two side walls of the press-button seat; two rotating axes extended outward from a center of the press button, and a pressing piece and a supporting piece located at two ends of the press button which is inserted into the side buckle casing after being installed on the press-button seat, enabling the press button to be passed out from the press-button hole.

2. The side buckle structure of swimming goggles according to claim 1, wherein the side buckle casing has openings at two ends, and the press-button hole is located thereon; one of the openings at one end of the side buckle casing used for installing the press-button seat and the press button, and the other opening at the other end forming a passage area for the head strap with the strap hole of the press-button seat.

3. The side buckle structure of swimming goggles according to claim 1, wherein the strap hole is located at one end of the press-button seat, and the latching hook is located at the other end having the strap hole; the placing holes located at proper positions on two side walls of the press-button seat, and the elastic devices located adjacent to the placing holes.

4. The side buckle structure of swimming goggles according to claim 1, wherein the two rotating axes are extended outward at two edges of the press button, and the pressing piece and the supporting piece are located at the two ends of the press button, respectively.

* * * * *